US010600340B2

(12) United States Patent
Scheidtmann et al.

(10) Patent No.: US 10,600,340 B2
(45) Date of Patent: Mar. 24, 2020

(54) ADAPTER APPARATUS AND METHOD FOR FASTENING AN INFORMATION CARRIER TO A CARRIER RAIL PROVIDED WITH TWO HOLDING DEVICES

(71) Applicant: Lidl Stiftung & Co. KG, Neckarsulm (DE)

(72) Inventors: Philipp Scheidtmann, Neckarsulm (DE); Rouven Witsch, Neckarsulm (DE)

(73) Assignee: Lidl Stiftung & Co. KG, Neckarsulm (DE)

( * ) Notice: Subject to any disclaimer, the term of this patent is extended or adjusted under 35 U.S.C. 154(b) by 0 days.

(21) Appl. No.: 16/279,775

(22) Filed: Feb. 19, 2019

(65) Prior Publication Data

US 2019/0259309 A1 Aug. 22, 2019

(30) Foreign Application Priority Data

Feb. 20, 2018 (DE) ..... 10 2018 103 755

(51) Int. Cl.
*G09F 3/20* (2006.01)
*G09F 7/10* (2006.01)
*G09F 15/00* (2006.01)

(52) U.S. Cl.
CPC ..... *G09F 3/204* (2013.01); *G09F 3/20* (2013.01); *G09F 3/208* (2013.01); *G09F 7/10* (2013.01); *G09F 15/00* (2013.01)

(58) Field of Classification Search
USPC ..... 211/119.003
See application file for complete search history.

(56) References Cited

U.S. PATENT DOCUMENTS 2,197,657 A * 4/1940 Churchill ..... G09F 3/18 40/652
3,530,605 A * 9/1970 Gutterson ..... G09F 1/10 40/658

(Continued)

FOREIGN PATENT DOCUMENTS

CN 104881697 9/2015
DE 3900904 2/1990

(Continued)

*Primary Examiner* — Kristina N Junge
(74) *Attorney, Agent, or Firm* — Head, Johnson, Kachigian & Wilkinson, PC

(57) ABSTRACT

An adapter device is described for fastening an information carrier to a support trail provided with two retaining means, wherein the adapter device includes a first leg and a second leg, each of which is supportable on one of the two retaining means. This adapter device is to be refined in such a way that a secure retention of the adapter device on the support rail is ensured, even after repeated mounting of the adapter device on or removal of the adapter device from the support rail and, at the same time, the costs for producing the adapter device are preferably minimal. To achieve this object, it is proposed to connect the first leg and the second leg to one another via a joint, wherein the first leg includes a first connection means for connecting the information carrier to the first leg, and the second leg includes a second connection means for connecting the information carrier to the second leg in such a way that in a mounted state, in which the information carrier is not connected to the adapter device, the first and the second leg are freely pivotable about the joint, and in a blockage state, in which the information carrier is connectable to the adapter device via the first and the second connection means, the joint may be blocked by the information carrier itself.

21 Claims, 14 Drawing Sheets

(56) References Cited

U.S. PATENT DOCUMENTS

Figure 1:
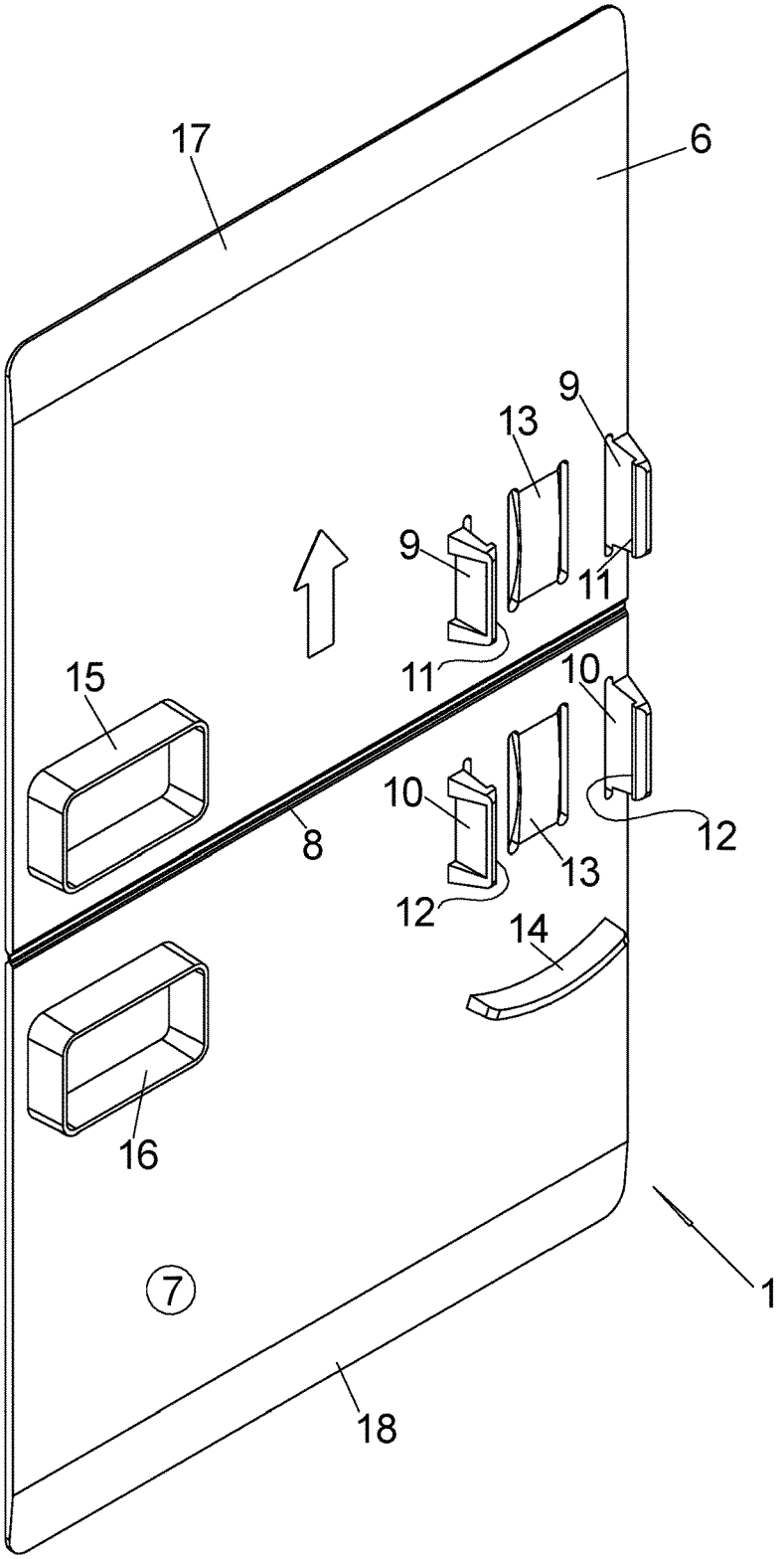

| | | | | |
|---|---|---|---|---|
| 3,797,143 | A * | 3/1974 | Miller | G09F 3/204 40/658 |
| 4,301,987 | A * | 11/1981 | Conway | A47F 5/0068 248/222.12 |
| 4,531,311 | A * | 7/1985 | Howard | G09F 3/20 40/649 |
| 5,375,803 | A * | 12/1994 | Kump | G09F 3/204 211/57.1 |
| 6,457,689 | B1 | 10/2002 | Padiak et al. | |
| 6,651,369 | B1 * | 11/2003 | Keating | G09F 3/204 40/658 |
| 7,882,969 | B2 * | 2/2011 | Gerstner | A47F 3/14 211/119.003 |
| 2009/0178314 | A1 | 7/2009 | Nguyen | |
| 2017/0221391 | A1 * | 8/2017 | Shuey | G09F 3/10 |

FOREIGN PATENT DOCUMENTS

| | | |
|---|---|---|
| DE | 19501972 | 7/1996 |
| DE | 19534671 | 3/1997 |
| DE | 102012105008 | 12/2013 |
| DE | 202015105014 | 11/2015 |
| DE | 202015105370 | 12/2015 |
| EP | 1849151 | 8/2006 |
| EP | 2230655 | 9/2010 |
| EP | 3035319 | 6/2016 |
| FR | 2992764 | 1/2014 |
| GB | 2276912 | 10/1994 |
| JP | 4759601 | 6/2011 |
| JP | 4861857 | 1/2012 |
| JP | 2016135318 | 7/2016 |
| KR | 101250264 | 3/2013 |
| KR | 101462791 | 11/2014 |
| KR | 1020160066357 | 6/2016 |
| NL | 2012191 | 2/2014 |
| WO | WO9519617 | 7/1995 |
| WO | WO9965288 | 12/1999 |
| WO | WO2008098337 | 8/2008 |
| WO | WO2012110086 | 8/2012 |
| WO | WO2013121091 | 8/2013 |
| WO | WO2016195479 | 12/2016 |

* cited by examiner

ADAPTER APPARATUS AND METHOD FOR FASTENING AN INFORMATION CARRIER TO A CARRIER RAIL PROVIDED WITH TWO HOLDING DEVICES

I. FIELD OF APPLICATION

The present invention relates to an adapter device and to a method for fastening an information carrier to a support rail provided with two retaining means. The adapter device is used, in particular, on shelves or on other means for displaying merchandise in retail stores, which include the support rail. The information carrier may be labels made of sufficiently rigid material such as, for example, cardboard or plastic with imprinted pieces of price information or product information, or advertising electronic labels, which display pieces of price information and/or product information. Electronic labels are known as ESL price boards (ESL=Electronic Shelf Labeling).

II. TECHNICAL BACKGROUND

A price tag trim for fastening to a price rail is known from DE 39 00 904 C1. The price tag trim includes a pocket for receiving a label, which is formed by a rear wall strip and a transparent cover strip. Attached to the rear side of the rear wall strip are a short and a long insert leg. The long insert leg is flexibly connected to the rear wall strip of the price tag trim.

The price rail includes two groove-like retaining means. The free ends of the insert legs are each inserted in one of the groove-like retaining means for fastening the price tag trim to the price rail. The price tag trim is then pressed against the price rail, as a result of which the long insert leg is pivoted into the position shown in FIG. 2 of DE 39 00 904 C1, in which it extends essentially in parallel to the rear wall strip or to the cover strip.

To secure the price tag trim on the price rail, a latching body mounted on the rear wall strip engages in a latching cavity situated on the long insertion leg and thereby ensures a secure retention of the free ends of the insert legs in the groove-like retaining means on the price rail. The price tag may be introduced into the pocket of the price tag rail before or after the price tag trim is mounted on the price rail.

The known price tag trim entails the disadvantage that the latching connection between the rear wall strips and the long insert leg may wear out so that a secure retention of the price tag trim on the price rail may then no longer be ensured. Moreover, the known price trim tag is relatively elaborate in design, so that its mass production is associated with comparatively high production costs.

III. DESCRIPTION OF THE INVENTION a) Technical Problem

Thus, it is the object of the present invention to create an adapter device, as well as a method for fastening an information carrier, in particular, a printed label, an electronic label or a monitor, to a support rail that is provided with two retaining means, which ensure or ensures a secure retention of the adapter device on the support rail, even after repeated mounting of the adapter device on, and removal of the adapter device from, the support rail and, at the same time, is associated with preferably minimal production costs.

b) Problem Solution

This object is achieved by an adapter device and by a method that includes the features of claims 1 and 15. Additional embodiments of the present invention arise from the subclaims.

According to the invention, an adapter device for fastening an information carrier, in particular, a printed label, an electronic label or a monitor, to a support rail that is provided with two retaining means is proposed, wherein the support rail is located, for example, on a shelf, on some other means for displaying merchandise, on a wall or suspended from a ceiling of a retail store. The adapter device includes a first leg and a second leg, each of which may be detachably supported on one of the two retaining means of the support rail. The two legs are preferably designed as flat bodies, the thickness dimension of which is significantly smaller than its dimensions in the other two spatial directions.

The first leg and the second leg of the adapter device are connected preferably directly to one another via a joint, wherein a first connection means for connecting the information carrier to the first leg is attached to the first leg, and a second connection means for connecting the information carrier to the second leg is attached on the second leg. Accordingly, the first and the second leg are in an mounted state of the adapter device, in which the information carrier is not connected to the adapter device, are freely pivotable about the joint and form an angle relative to one another of less than 180°. In a blockage state of the adapter device, in which the information carrier is connectable to the adapter device via the first and the second connection means, the joint may be blocked by the information carrier itself.

The legs in the blockage state form an angle of essentially 180° and thus lie essentially in a plane spanned by the legs. The information carrier, for example, a printed or electronic label, exhibits an intrinsic flexural strength that is sufficient to hold the legs blocked in the blockage state. Thus, the information carrier acts like a mechanical blockage lock, which holds both legs in an stretched or flat state due to its connection to both the first leg as well as to the second leg.

Since the information carrier itself may act in the adapter device according to the invention as a mechanical blockage lock, it is not necessary to provide additional mechanical locking or securing means on the adapter device itself, which wear out after repeated use and, as a result, could lose their locking or securing effect. The task of ensuring a secure retention of the adapter device on the support rail is instead shifted to the information carrier itself. The information carrier is subject to, if at all, only very minimal wear, even if the adapter device is repeatedly mounted on or removed from the support rail.

Moreover, the lacking necessity of additional mechanical locking or securing means on the adapter device itself means that the design of the adapter device according to the invention may be kept comparatively simple and thus cost-efficient to produce. Selecting plastic as material for the adapter device offers, for example, a cost-efficient production by means of injection molding in which, given the simple design of the adapter device according to the invention, only correspondingly simple injection molds need be provided.

In the adapter device, the first connection means and the second connection means are preferably identically designed. Alternatively, it is conceivable, for example, as a function of the design of the rear side of the information carrier, to design the first connection means differently from the second connection means in terms of its type and operation.

In conjunction with the present invention, the information carrier may be connected in various ways to the first leg and to the second leg of the adapter device. On the one hand, it is conceivable to establish a latching connection between the information carrier and the first leg or the second leg of the adapter device by means of the first connection means and/or of the second connection means. On the other hand, there is the option of establishing a slide connection between the information carrier and the first leg or the second leg of the adapter device by means of the first connection means and/or of the second connection means. Finally, it is also conceivable to provide a combined slide connection and latching connection between the information carrier and the first leg or the second leg of the adapter device. The last mentioned combined variant offers the user of the adapter device maximum handling freedom, if it involves attaching the information carrier to the adapter device as a function of the spatial surroundings conditions in which the support rail is situated.

A latching connection may, for example, be designed in such a way that the first connection means and/or the second connection means include at least two latching fingers with latching lugs, between which the information carrier is engageable from the front. A slide connection may, for example, be designed in such a way that the first connection means and/or the second connection means include(s) at least two guide fingers with guide lugs, between which the information carrier is insertable, preferably from above. In the combined latching and slide connection, it is particularly advantageous if the guide fingers with the guide lugs also form the latching fingers with the latching lugs.

In order to prevent the information carrier attached to the adapter device from wobbling, at least one flat spring may be designed, in each case in or on the first leg and in or on the second leg. The at least one flat spring presses the information carrier free of play against the latching lugs and/or guide lugs holding the information carrier. In the process, the flat spring is formed in each case preferably by a curved material web made from the material of the first leg or from the material of the second leg. The flat spring may be advantageously situated between the latching fingers and/or between the guide fingers.

The second leg may advantageously include a stop projection as a stop for the information carrier. This stop enables a uniform positioning of all of the information carriers supported by the support rail, in particular, in the case of multiple adapter devices on one support rail. In the case of a horizontally extending support rail, the second leg forms the lower leg of the adapter device and the stop then forms a vertical stop for the information carrier.

In information carriers, especially in those that are comparatively large in plan view, the first leg and/or the second leg may include a spacer projection which, as a positioning aid, serves to position the information carrier in the blockage state essentially parallel to the plane spanned by the first leg and by the second leg.

The first leg and/or the second leg each include a retaining edge on its free end facing away from the joint, which may positively engage in the respective retaining means on the support rail. This retaining edge in the first leg and/or in the second leg has a flattened design, in order to facilitate the introduction into the retaining means of the support rail, designed, for example, as retaining grooves.

The joint connecting the first leg to the second leg needs merely to have a degree of freedom and may be of any type. A film hinge, which may be used, in particular, in the production of the adapter device according to the invention made of plastic, has proven advantageous as well as cost-efficient.

According to the invention, a method for fastening an information carrier, for example, a printed or electronic label, to a support rail provided with two retaining means is proposed, in which an adapter device according to the invention is used. The method comprises as a first step, the pivoting of the first leg relative to the second leg about the joint to thereby obtain a bent adapter device, in which the two legs form an angle of less than 180° relative to one another. The joint in the bent adapter device is flexed in such a way that the retaining edges of the first leg and of the second leg facing away from the joint occupy a spatial distance from one another, which is smaller than a predefined distance, which the two retaining means of the support rail exhibit relative to one another. This enables the second step of the method according to the invention, according to which the bent adapter device is positively introduced with its retaining edges into the support rail.

In conjunction with a third step of the method according to the invention, the first leg is pivoted relative to the second leg about the joint to obtain a stretched adapter device in the support rail, in which the joint is stretched and an angle of essentially 180° is formed between the first leg and the second leg.

In conjunction with the fourth and last step of the method according to the invention, the information carrier is connected both to the first connection means of the first leg as well as to the second connection means of the second leg. As a result, the joint of the stretched adapter device is blocked by the information carrier itself, and the retaining edges of the first leg and of the second leg are held in a retaining connection with the two retaining means of the support rail.

c) Exemplary Embodiments

Figure 2:
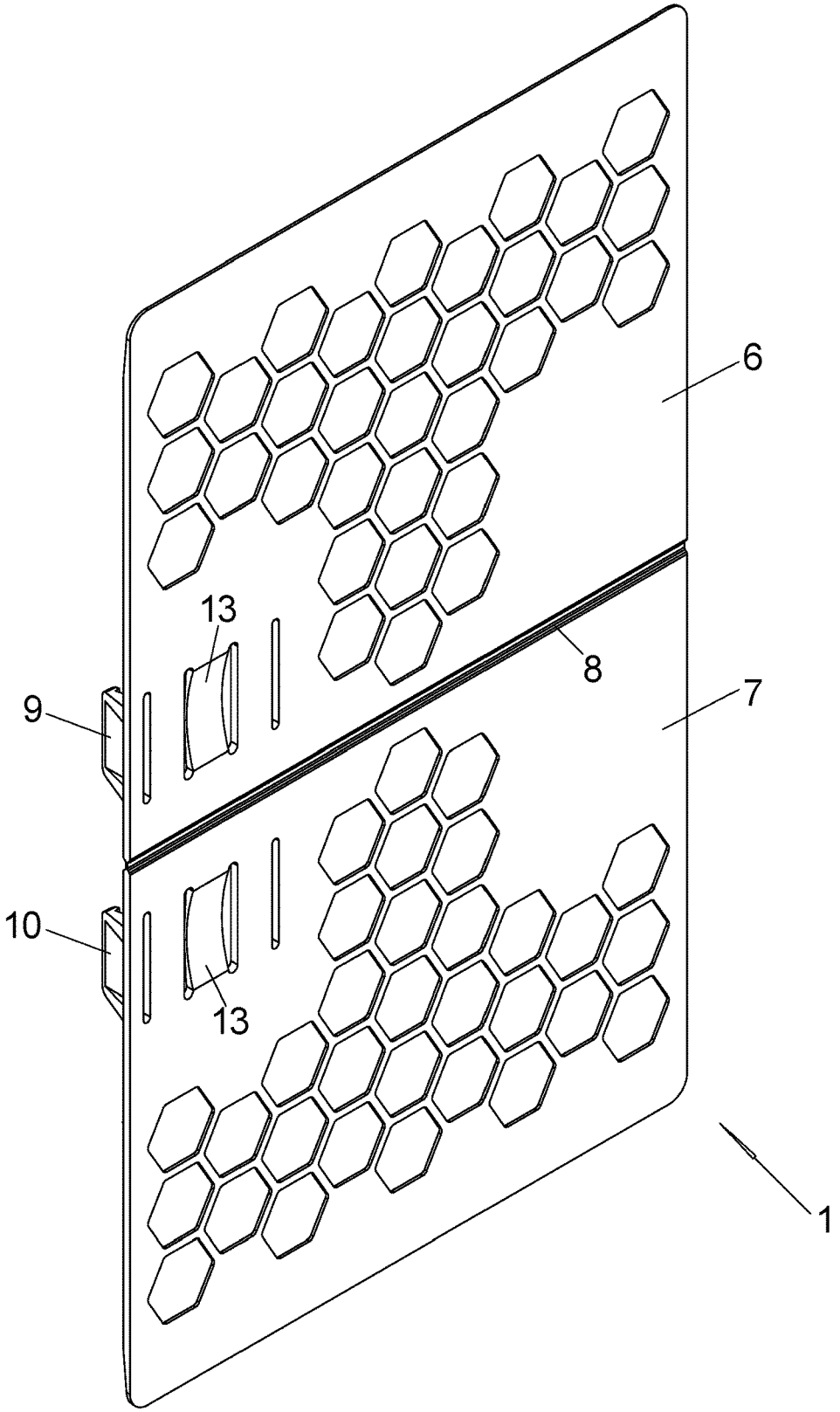
Figure 3:
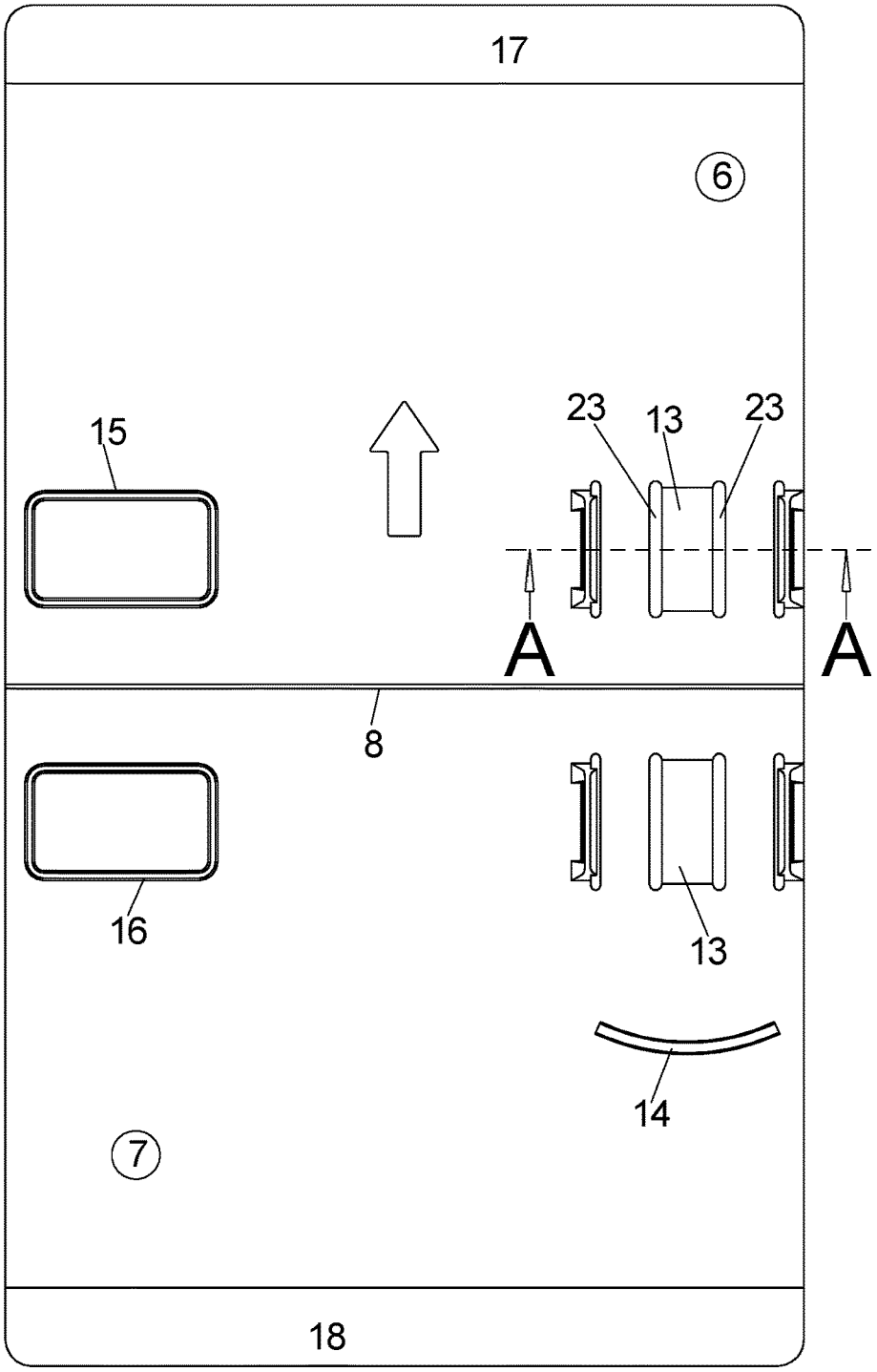
Figure 4:
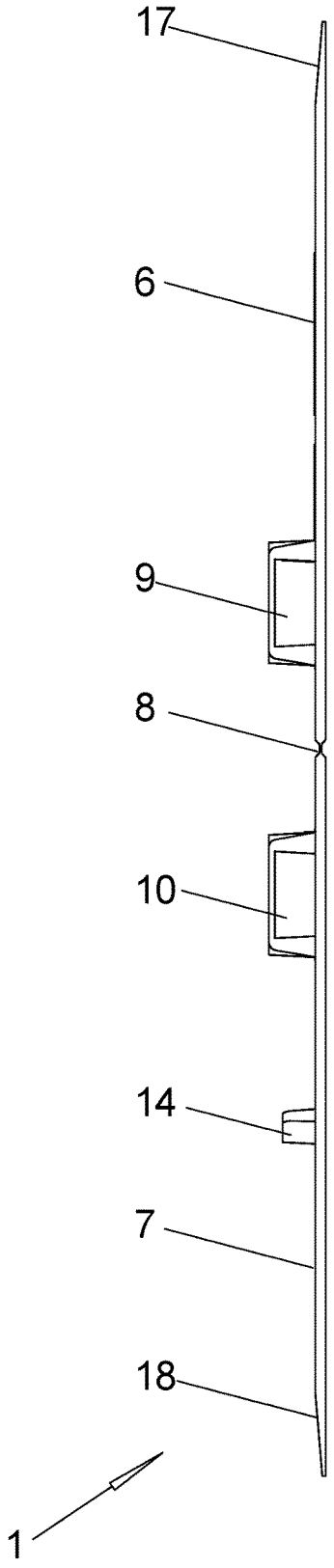
Figure 5:
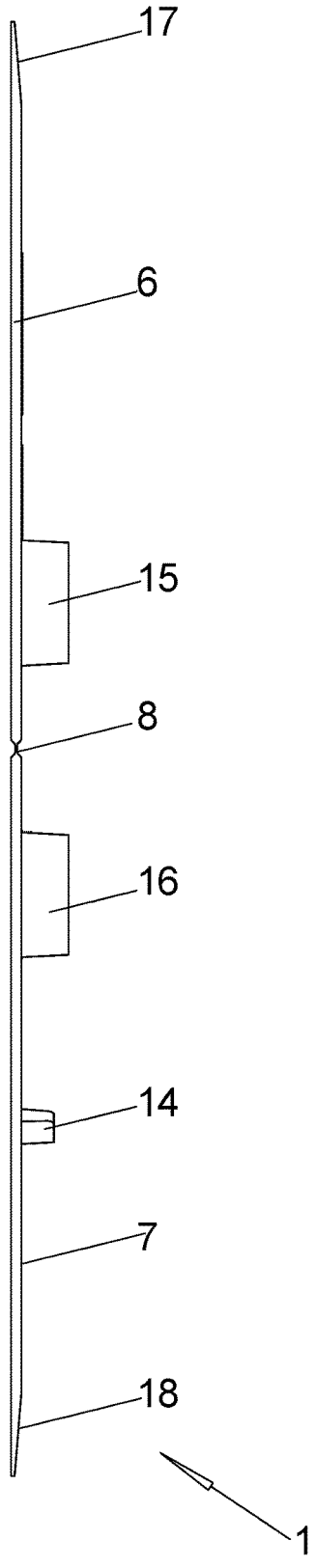
Figure 6:
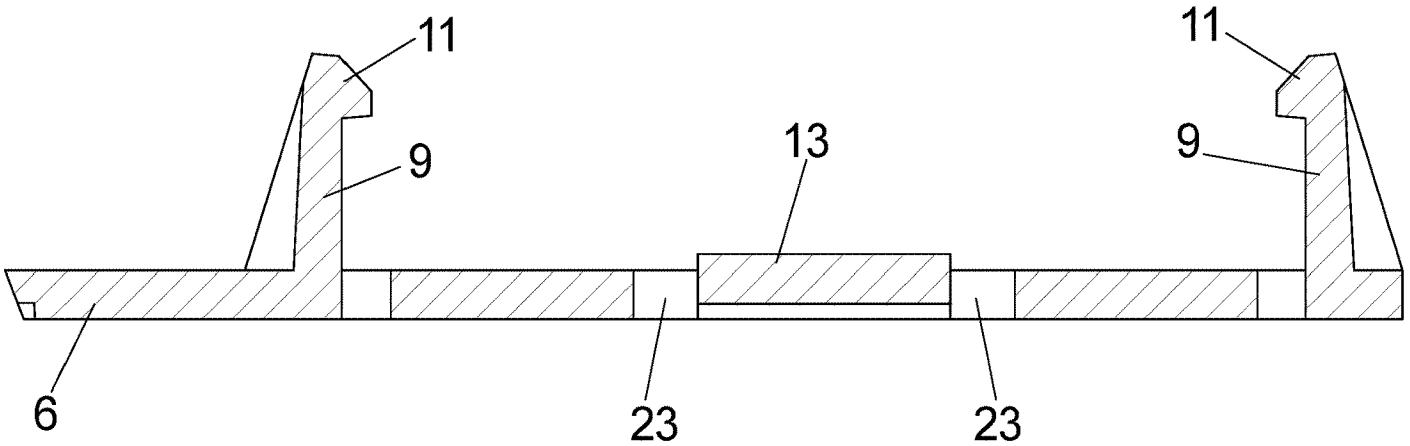
Figure 7:
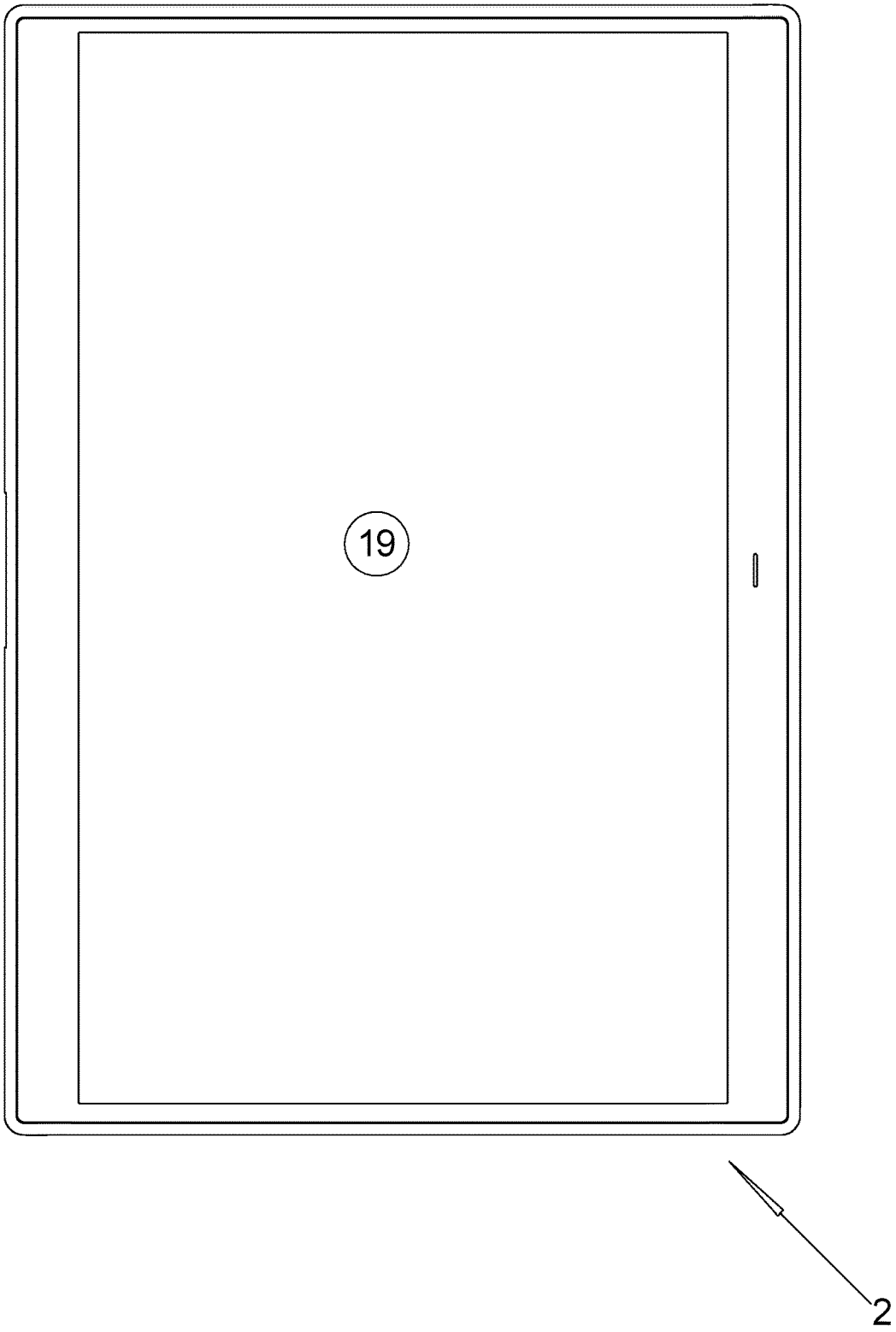
Figure 8:
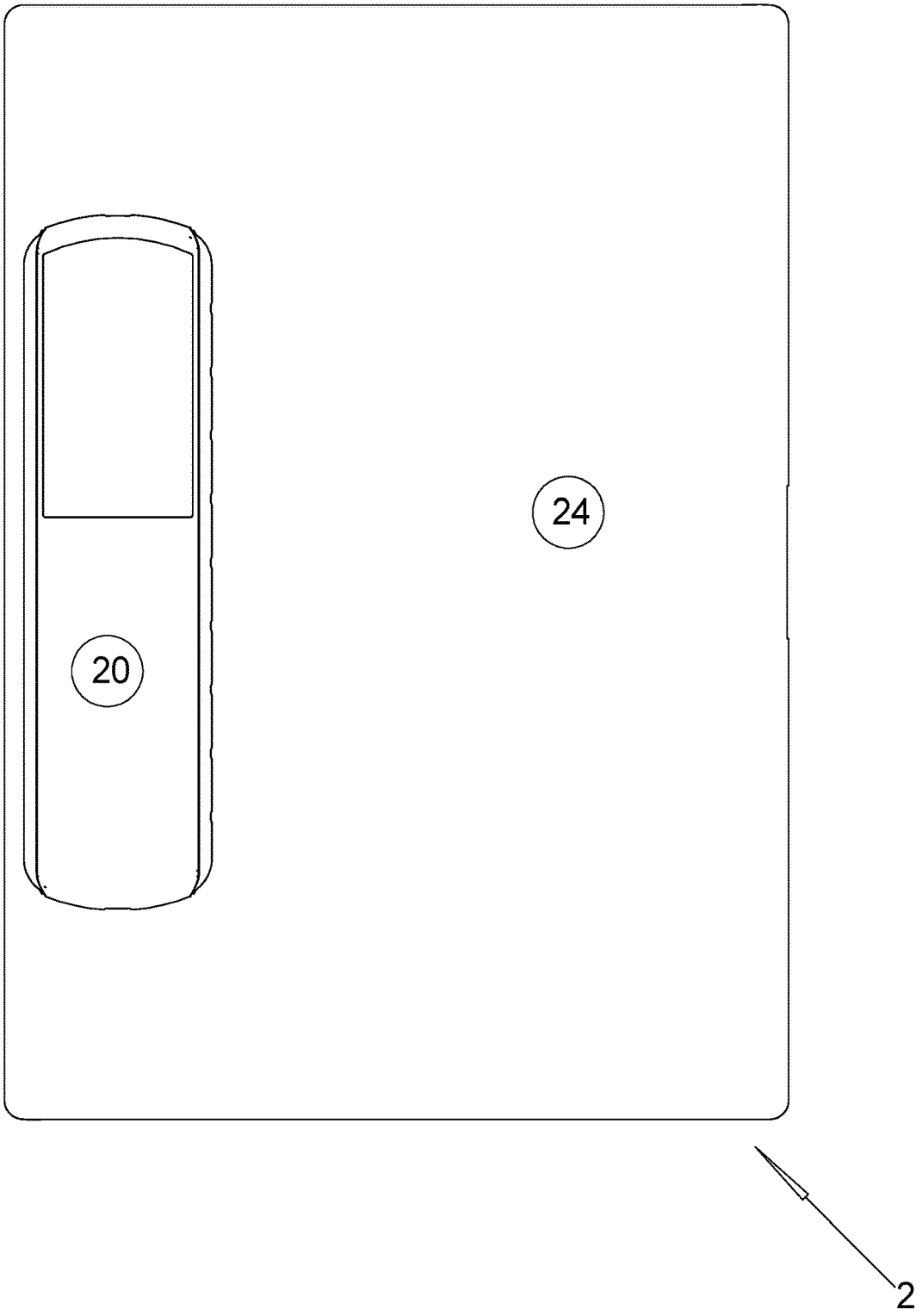
Figure 9:
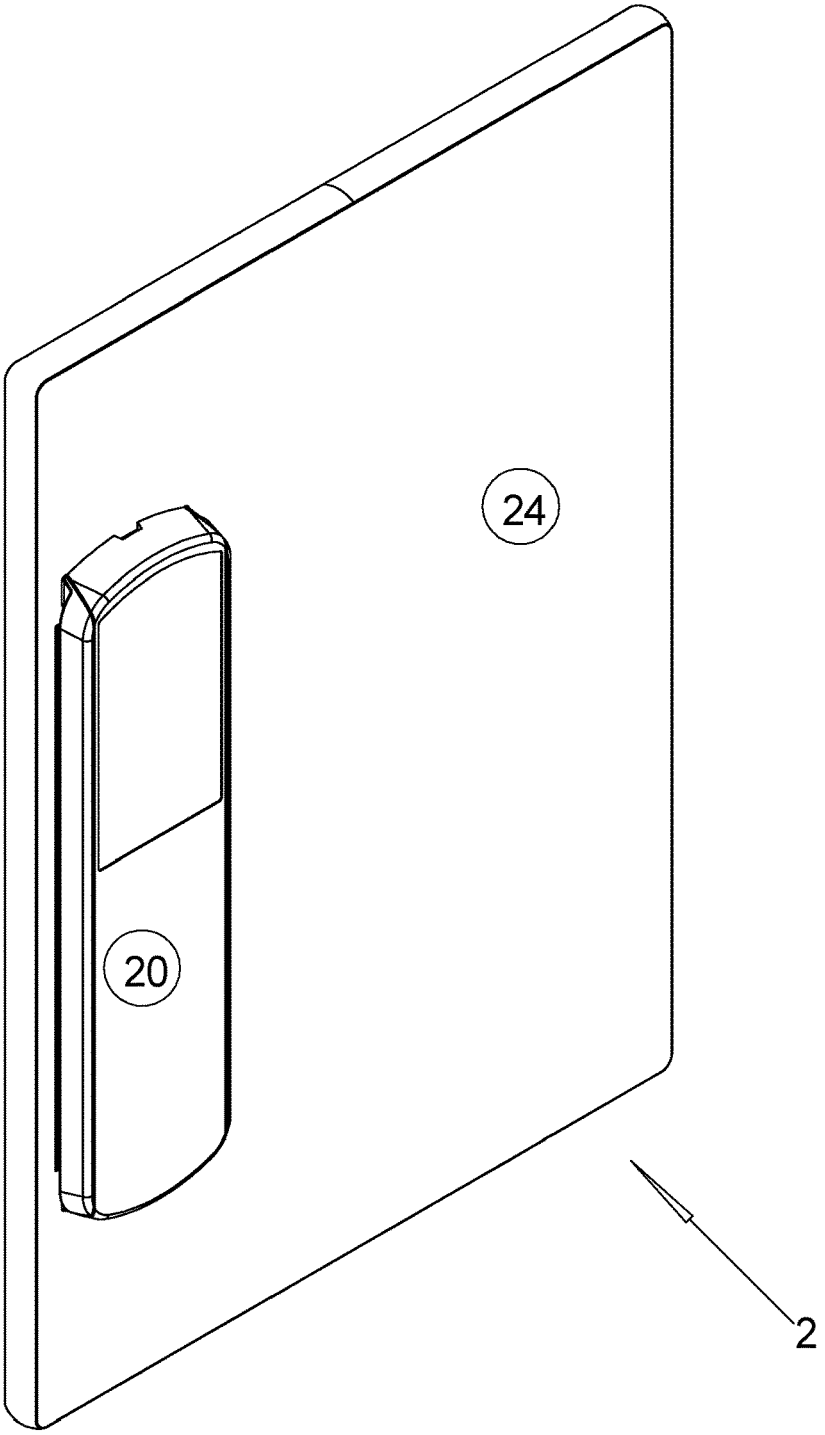
Figure 10:
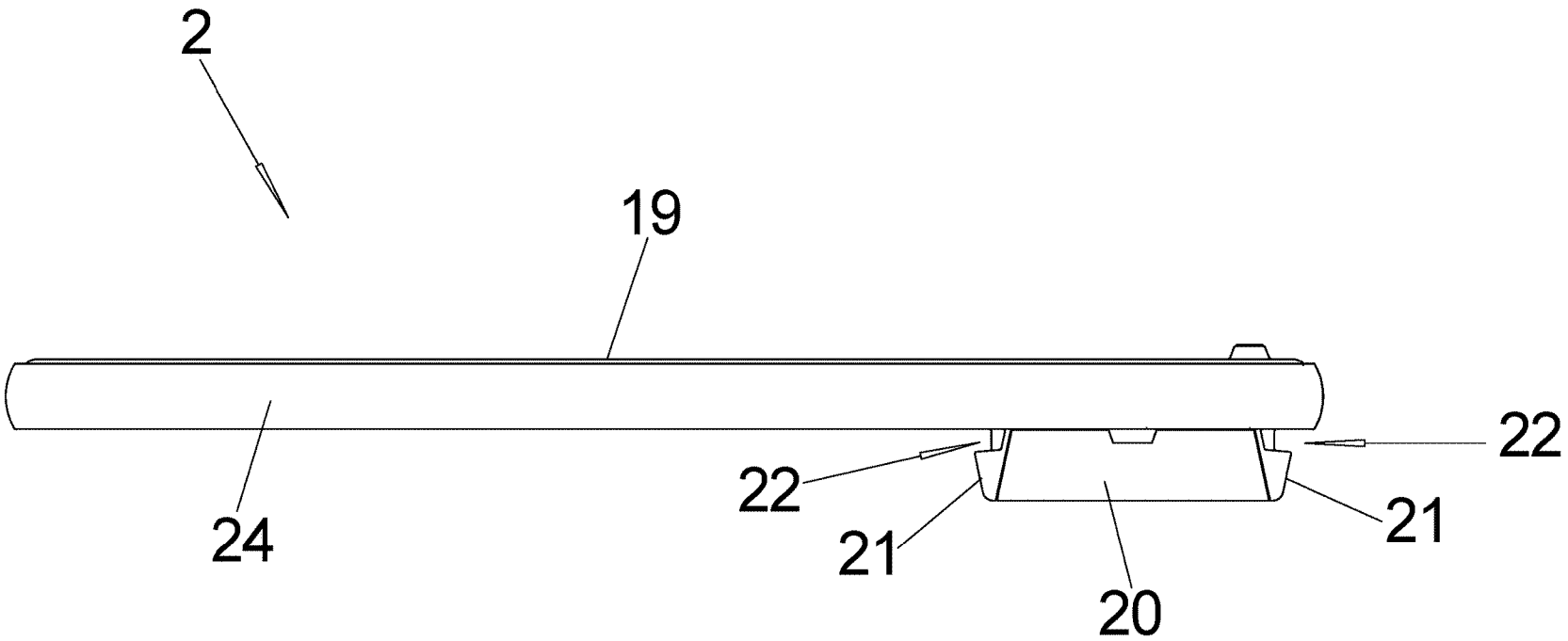
Figure 11:
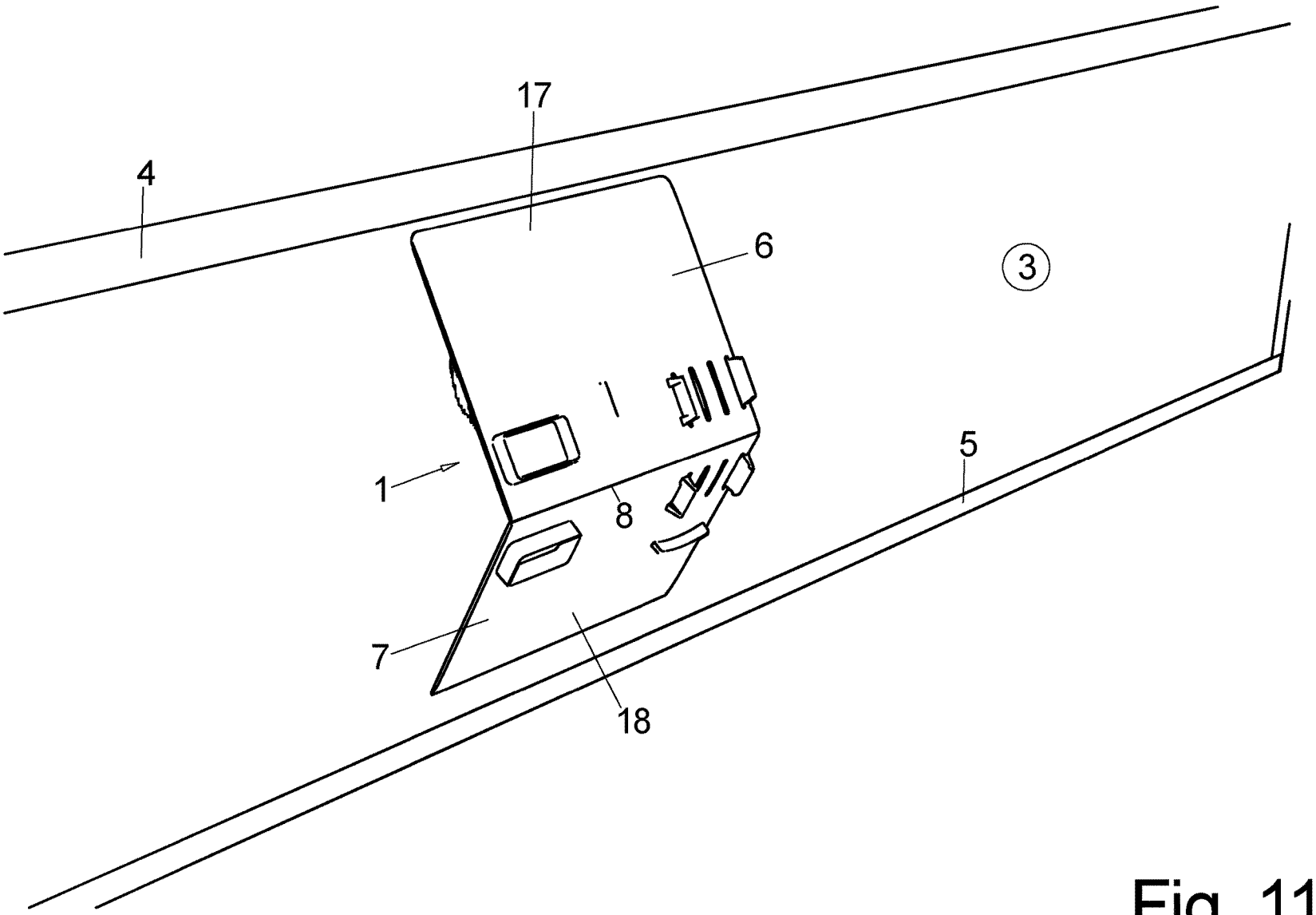
Figure 12:
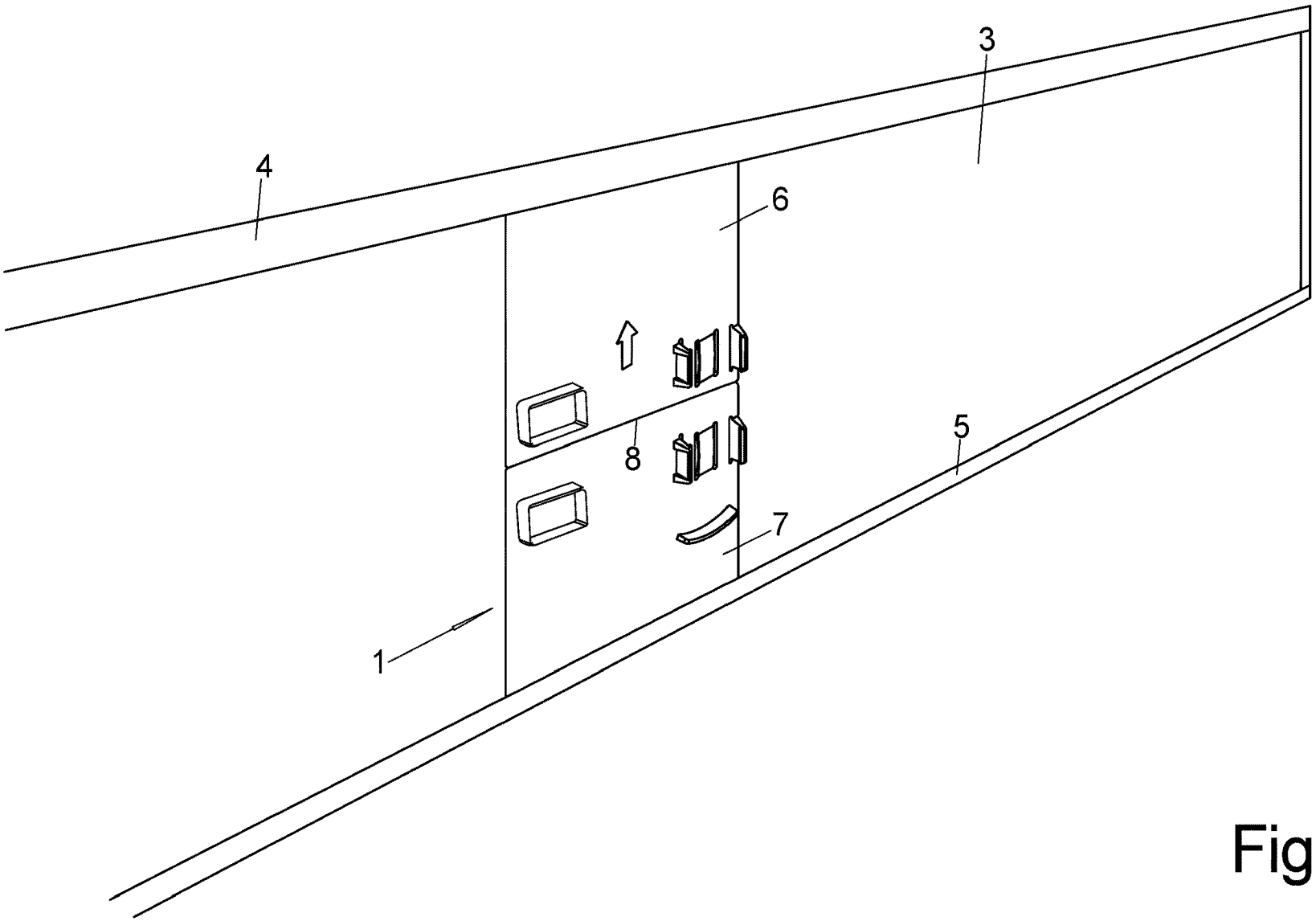
Figure 13:
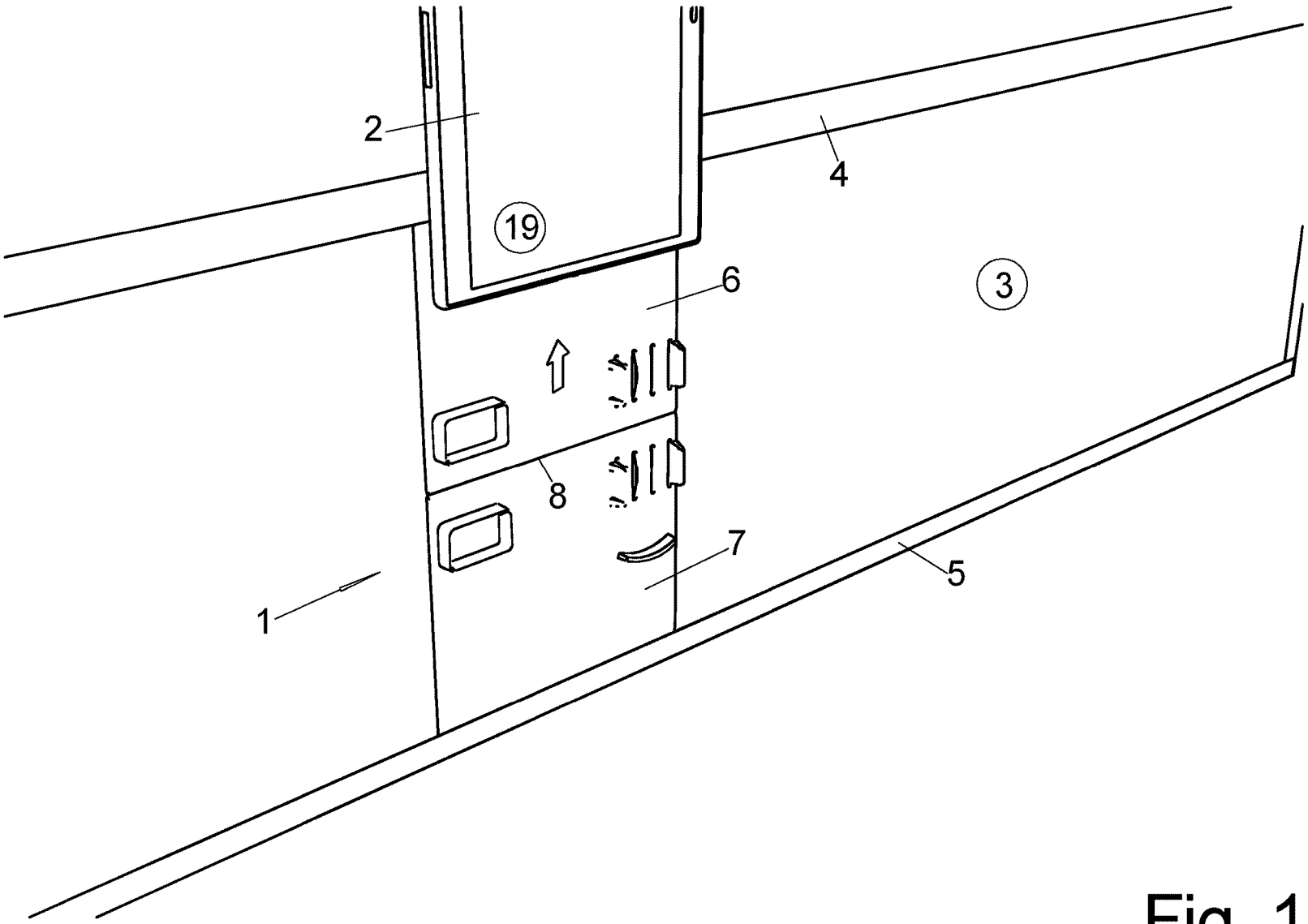
Figure 14:
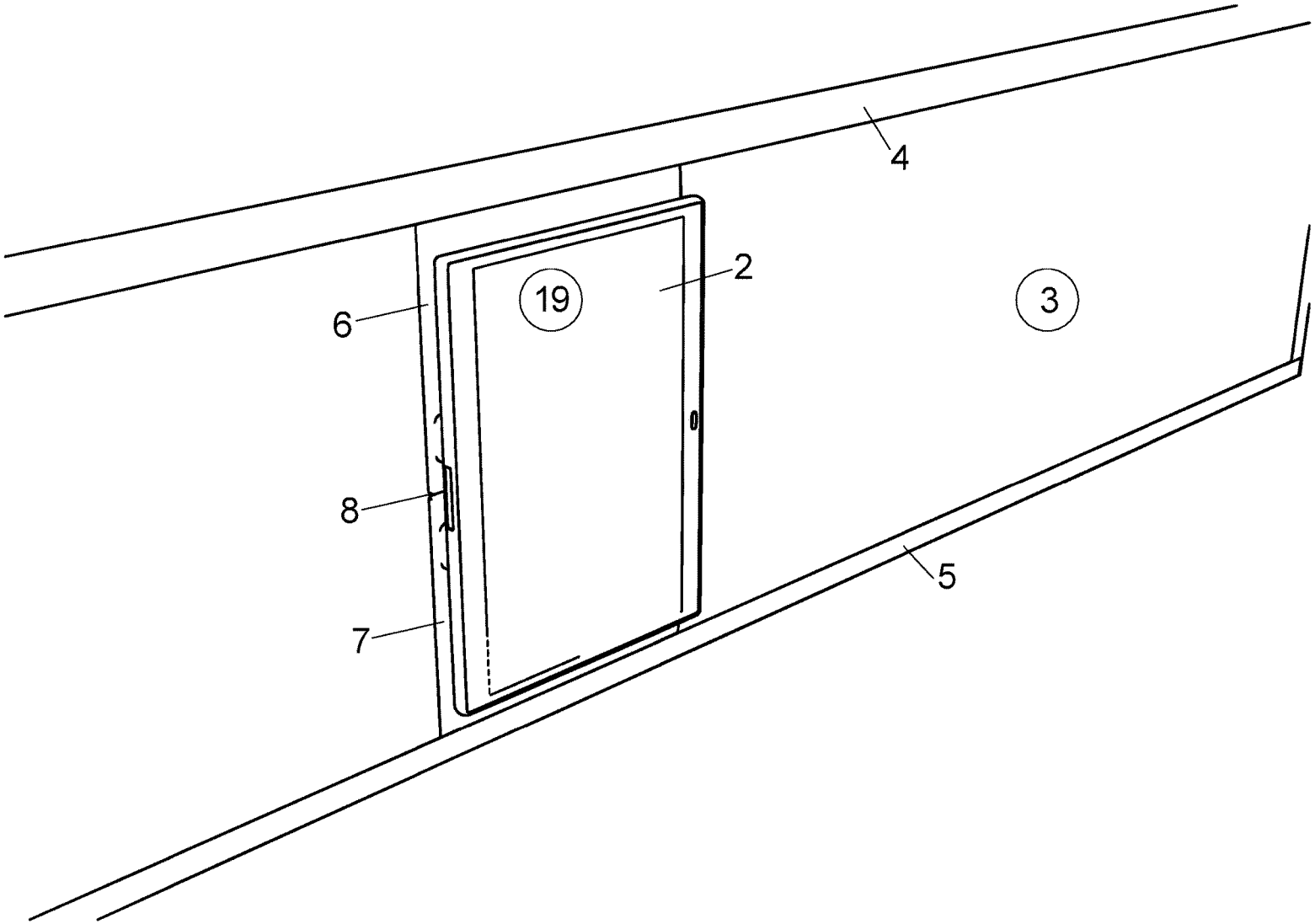
Figure 15:
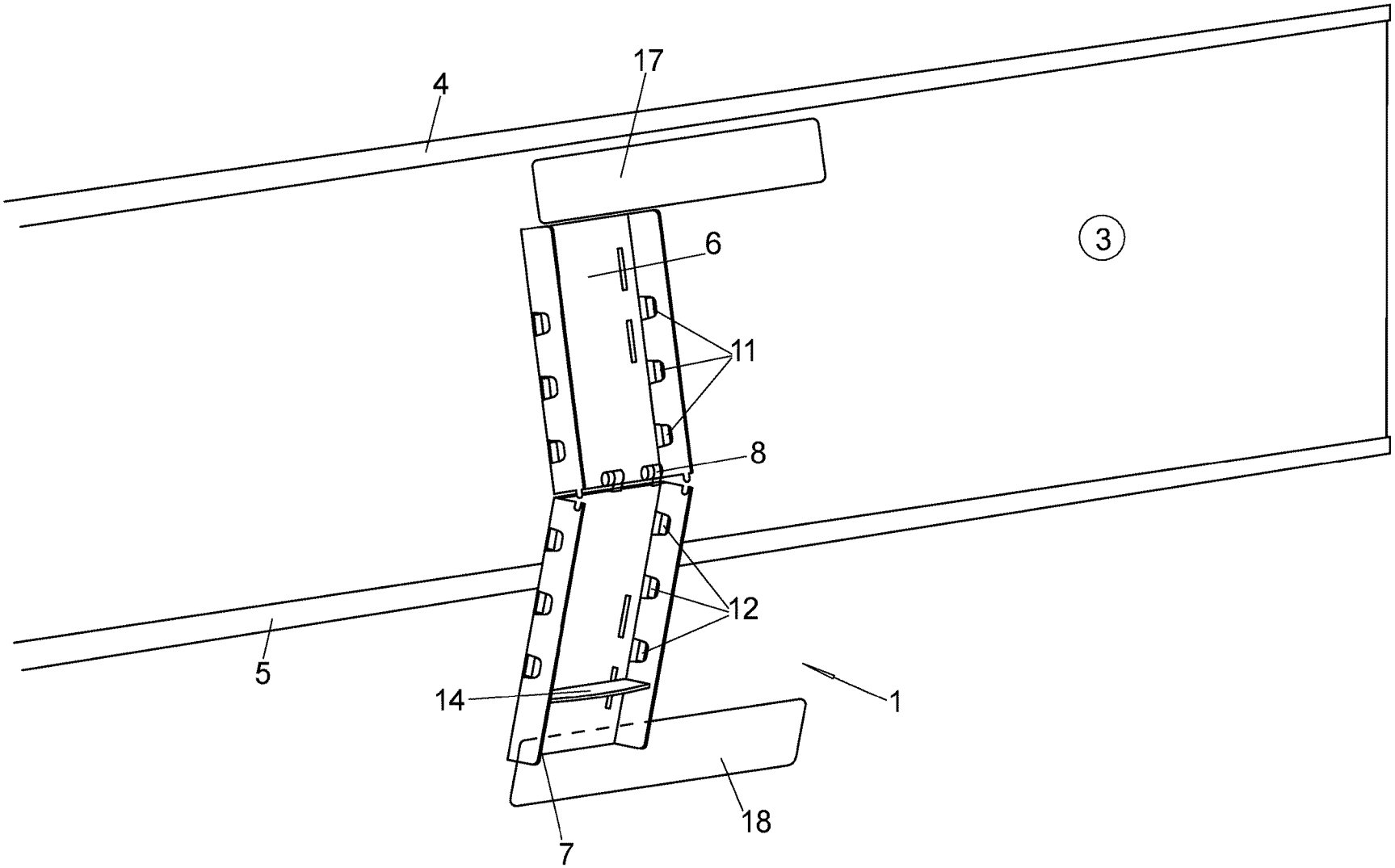

Exemplary embodiments of the present invention are described below by way of example with reference to the appended drawings, in which:

FIG. 1: shows a perspective view of the front side of a first exemplary embodiment of the adapter device according to the invention;

FIG. 2: shows a perspective view of the rear side of the adapter device shown in FIG. 1;

FIG. 3: shows a view of the front side of the adapter device shown in FIG. 1;

FIG. 4: shows a side view of the adapter device shown in FIG. 3 from the right;

FIG. 5: shows a side view of the adapter device shown in FIG. 3 from the left;

FIG. 6: shows an enlarged sectional view according to section A-A in FIG. 3;

FIG. 7: shows a view of the front side of an information carrier in the form of an electronic label, which is provided for fastening to a support rail by means of the adapter device according to the invention;

FIG. 8: shows a view of the rear side of the information carrier shown in FIG. 7;

FIG. 9: shows a perspective view of the rear side of the information carrier shown in FIG. 8;

FIG. 10: shows a side view of the information carrier shown in FIG. 7 from below;

FIG. 11: shows a perspective view of a support rail, together with the first exemplary embodiment of the adapter device according to the invention in its bent mounted state;

FIG. 12: shows a perspective view corresponding to FIG. 11, wherein the adapter device is situated in a blockage state;

FIG. 13: shows a perspective view corresponding to FIG. 12, wherein a part of the information carrier shown in the FIGS. 7-10 is also depicted just prior to connection to the adapter device;

FIG. 14: shows a perspective view corresponding to FIG. 13, wherein the information carrier is situated in its final position connected to the adapter device, in which it blocks the joint of the adapter device; and FIG. 15: shows a perspective view of a support rail, together with a second exemplary embodiment of the adapter device according to the invention in its bent mounted state.

Identical reference numerals are used for identical parts or elements below. If identical reference numerals are used in conjunction with the two different exemplary embodiments, then the parts or elements labeled with matching reference numerals correspond to one another in terms of function.

FIG. 1 shows a perspective view of a first exemplary embodiment of the adapter device according to the invention. The adapter device 1 includes a first leg 6 and a second leg 7, which are directly connected to one another via a joint 8 in the form of a film hinge. The legs 6 and 7 are designed as rectangular-shaped flat bodies, as is apparent in the FIGS. 1-5. The entire adapter device 1 according to the first exemplary embodiment is produced as a single piece from plastic.

As is most apparent in FIG. 1 and in FIG. 6, which shows an enlarged sectional view according to section A-A in FIG. 3, two guide fingers 9 spaced apart from one another project forward away from the leg 6. The free ends of the two guide fingers 9 each include a guide lug 11. In the same structural manner, two guide fingers 10, each of which includes a guide lug 12 on its free end, project away from the leg 7.

The guide fingers 9 and the guide lugs 11 form a first connection means, with the aid of which an information carrier 2 in the form of an electronic label shown in the FIGS. 7-10 and in FIGS. 13 and 14 may be connected to the first leg 6. Similarly, the guide fingers 10 and the guide lugs 12 form a second connection means, with the aid of which the aforementioned information carrier 2 may be connected to the second leg 7.

In the FIGS. 7-10, an information carrier in the form of an electronic label 2 is shown, which is to be fastened to a support rail 3 partially depicted in the FIGS. 11-14 with the aid of the adapter device 1. The support rail 3 is situated, for example, on shelves or on other means for displaying merchandise in retail stores such as, for example, supermarkets. The electronic label 2 includes a display device 19, for example, in the form of a LCD display or in the form of an electronic paper (passive, non-illuminating displays, which simulate the appearance of ink or color on paper), on which pieces of product information and price information may be displayed regarding merchandise, which is spatially associated with the arrangement position on the shelf or on some other means for displaying merchandise provided for the label 2.

As is apparent in FIGS. 8-10, the electronic label 2 includes an electronic unit 20 on its rear side 24, in which all of the hardware components and software components necessary for the operation of the electronic label 2 may be situated, which are not shown in FIGS. 8-10 and which include, for example, a battery, a data memory for storing pieces of product information and price information to be displayed, as well as a processor. As is most apparent in FIG. 10, the electronic unit 20 includes guide projections 21 along its side edges to the left and right in FIG. 8, which form guide recesses 22 between themselves and the rear side 24 of the electronic label 2. The guide projections 21 and guide recesses 22 may, of course, depending on the design of the label 2 used, also be designed fully independently of the presence an electronic unit 20 protruding from the rear side 24. The main objective is that the guide projections 21 and guide recesses 22 are able to interact in order to establish a connection with the guide fingers 9 and 10 as well as with the guide lugs 11 and 12.

In the blockage state shown in FIG. 1, in which the legs 6 and 7 are situated in a plane and together form an angle of 180°, the electronic label 2 with its electronic unit 20 in FIG. 1 may be slid between the guide fingers 9 and guide fingers 10 from above in such a way that the guide lugs 11 on the one hand and the guide lugs 12 on the other hand engage in the guide recesses 22 situated on the electronic label 2. Thus, a slide connection exists between the electronic label 2, as well as the leg 6 and the leg 7 of the adapter device 1. To prevent the label 2 in FIG. 1 from falling downward out of the guide fingers 9 and 10, a forward protruding stop projection 14 is situated on the leg 7, against which the lower end of the electronic unit 20 apparent in the FIGS. 8 and 9 may abut. Accordingly, the stop projection 14 in the exemplary embodiment shown acts like a vertical stop.

Instead of the slide connection between the electronic label 2 and the adapter device 1 provided in the first exemplary embodiment, a latching connection may alternatively also be provided between the electronic label 2 and the adapter device 1. For this purpose, the guide fingers 9 and 10 could, for example, be designed with an inherent elasticity such that the electronic label 2 with its electronic unit 20 could be pressed from the front in FIGS. 1 and 3 or from above in FIG. 6 against the leg 6 and the leg 7, in order to produce the connection with the adapter device 1. Such a variant mounting from a direction perpendicular to the plane spanned by the legs 6 and 7 could be advantageous if the mechanical surroundings conditions in which the support rail 3 is situated do not allow the label 2 in FIG. 1 to be inserted from above. In this context, it would be particularly advantageous to design the guide fingers 9 and 10, as well as the guide lugs 11 and 12, both as guide elements as well as latching elements. This would ensure the greatest possible flexibility with respect to the mounting direction of the electronic label 2.

To ensure an optimally wobble-free seating of the electronic label 2 on the adapter device 1, the first exemplary embodiment includes one flat spring each between the two guide fingers 9, as well as between the two guide fingers 10. As is most apparent in FIGS. 1 and 2, the flat spring 13 is formed by a material web curved forward outwardly in FIG. 1 from the plane of the leg 6 or 7, which is segregated from the remaining material of the leg 6 or 7 to the left and to the right of one through-slot 23 each (cf. FIG. 6). The flat spring 13 is integrally connected at its upper and lower end in FIGS. 1 and 2 to the remaining material of the leg 6 or 7.

If the electronic label 2 with its electronic unit 20 in FIG. 1 is slid between the guide fingers 9 and 10 from above, then the two flat springs 13 press the electronic unit 20 forward in FIGS. 1 and 3 and upward in FIG. 6. In the process, the guide projections 21 shown in FIG. 10 are pressed against the guide lugs 11 and 12, so that the electronic unit 20 is guided free of play in the direction perpendicular to the plane spanned by the legs 6 and 7.

As is apparent in FIGS. 1, 3 and 5, the first leg 6 includes a spacer projection 15 protruding forward from the latter in the FIGS. 1 and 3 and to the right in FIG. 5, which in the exemplary embodiment shown is designed in the form of a rectangular, closed circumferential material web. A correspondingly identically designed spacer projection 16 is attached to the leg 7. The spacer projections 15 and 16 serve as positioning aids which, in the case of the electronic label 2 attached to the adapter device 1, come to bear on the rear side 24 of the electronic label 2 visible in FIGS. 8-10, in order to hold the label 2 preferably parallel to the plane spanned by the legs 6 and 7 in FIGS. 1 and 3. This prevents the label 2 in the state attached to the adapter device 1 from twisting in the direction of the adapter device 1 about a vertical axis extending between the guide fingers 9 and the guide fingers 10.

Similar to FIGS. 1, 3, 4 and 5, the leg 6 includes on its end facing away from the hinge 8 a retaining edge 17, which has a flattened design in the exemplary embodiment shown (cf. FIGS. 4 and 5). Similarly, the leg 7 includes a retaining edge 18 on its end facing away from the joint 8 which, similar to the retaining edge 17 of the leg 6, has a flattened design in the exemplary embodiment shown.

FIGS. 11-14 illustrate the process of mounting the adapter device 1 on the support rail 3, as well as the mounting of the electronic label 2 on the adapter device 1. The support rail 3, designed, for example, as a profile rail made of aluminum, includes a retaining means 4 and 5 above and below in the FIGS. 11-14, in each case in the form of a retaining groove not apparent for receiving the retaining edges 17 and 18 of the adapter device 1.

According to FIG. 11, the adapter device 1 is initially moved into its mounted state, in which the legs 6 and 7 are bent relative to one another, i.e, together form an angle of less than 180°. The bending angle between the legs 6 and 7 is to be selected so that the retaining edges 17 and 18 of the adapter device 1 may be positively inserted into the retaining means 4 and 5 of the support rail. As shown in FIG. 12, the adapter 1 is subsequently moved into its stretched blockage state, in which the legs 6 and 7 span a common plane and form an angle of essentially 180° relative to one another. Both retaining edges 17 and 18 are then situated in the groove-like retaining means 4 and 5 of the support rail 3 and are therefore no longer visible in FIG. 12.

As shown in FIG. 13, the electronic label 2 with its electronic unit 20 shown in FIGS. 8-10 is subsequently slid between the guide fingers 9 and 10 from above until it abuts the stop projection 14. This state is shown in FIG. 14. In FIG. 14, it is also readily apparent that the electronic label 2 is approximately as large in its plan view as the adapter device 1 itself, so that the latter is barely noticeable when the label 2 is mounted.

FIG. 15 shows a second exemplary embodiment of the adapter device 1 according to the invention in front of the support rail 3 with its groove-like retaining means 4 and 5. Unlike the first exemplary embodiment, the legs 6 and 7 here have an L-shaped design. The retaining edges 17 and 18 are each situated on the shorter L-leg. The joint 8 is not a film hinge as in the first exemplary embodiment, but rather a hinge similar to a piano hinge. The first leg 6 in the second exemplary embodiment includes a total of six guide lugs 11. The second leg 7 is similarly provided with a total of six guide lugs 12. Unlike the first exemplary embodiment, here elongated guide walls are designed acting in a similar manner to the guide fingers 9 and 10, which are significantly longer than the guide fingers 9 and 10, and which extend over the entire length of the respective long L-leg of the leg 6 or 7.

The fundamental procedure for mounting the adapter device 1 shown in FIG. 15 on the support rail 3 and for mounting the electronic label 2 on the adapter device 1 is the same as was described in conjunction with the first exemplary embodiment.

LIST OF REFERENCE NUMERALS

1 adapter device
2 information carrier (electronic label)
3 support rail
4 retaining means of the support rail 3
5 retaining means of the support rail 3
6 first leg
7 second leg
8 joint
9 guide finger of the leg 6
10 guide finger of the leg 7
11 guide lug of the guide finger 9
12 guide lug of the guide finger 10
13 flat spring
14 stop projection
15 spacer projection of the leg 6
16 spacer projection of the leg 7
17 retaining edge of the leg 6
18 retaining edge of the leg 7
19 display device
20 electronic unit
21 guide projection
22 guide recess
23 through-slot
24 rear side of the electronic label 2

The invention claimed is:

1. An adapter device (1) for fastening an information carrier (2) to a support rail (3) provided with two retaining means (4, 5), wherein the adapter device (1) comprises:

a first leg (6) and a second leg (7), each of which is supportable on one of the two retaining means (4, 5), characterized in that the first leg (6) and the second leg (7) are connected to one another via a joint (8), the first leg (6) includes a first connection means (9) for connecting the information carder (2) to the first leg (6), and the second leg (7) includes a second connection means (10) for connecting the information carrier (2) to the second leg (7) in such a way that in a mounted state, in which the information carrier (2) is not connected to the adapter device (1), the first and the second leg (6, 7) are freely pivotable about the joint (8), and in a blockage state, in which the information carrier (2) is connectable to the adapter device (1) via the first and the second connection means (9, 10), the joint 8 may be blocked by the information carrier (2) itself and the first leg and the second leg form an angle of essentially 180° with one another.

2. The adapter device (1) according to claim 1, characterized in that the first connection means (9) and the second connection means (10) are identically designed.

3. The adapter device (1) according to claim 1, characterized in that a latching connection may be established between the information carrier (2) and the first leg (6) or the second leg (7) by means of the first connection means and/or of the second connection means.

4. The adapter device (1) according to claim 3, characterized in that the first connection means and/or the second connection means includes at least two latching fingers with latching lugs, between which the information carrier (2) is engageable.

5. The adapter device (1) according to claim 4, characterized in that at least one flat spring (13) each is formed in the first leg (6) and in the second leg (7), with the aid of which the information carrier (2) may be pressed free of play against the latching lugs.

6. The adapter device (1) according to claim 5, characterized in that the flat spring (13) in each case is a curved material web of the first leg (6) and of the second leg (7).

7. The adapter device (1) according to claim 6, characterized in that the flat spring (13) is situated between the latching fingers.

8. The adapter device (1) according to claim 1, characterized in that a slide connection may be established between the information carrier (2) and the first leg (6) or the second leg (7) by means of the first connection means and/or of the second connection means.

9. The adapter device (1) according to claim 8, characterized in that the first connection means or the second connection means includes at least two guide fingers (9, 10) with guide lugs (11, 12), between which the information carrier (2) may be inserted.

10. The adapter device (1) according to claim 9, characterized in that a latching connection may be established between the information carrier (2) and the first leg (6) or the second leg (7) by means of the first connection means or of the second connection means, wherein the first connection means or the second connection means include(s) at least two latching fingers with latching lugs, between which the information carrier (2) is insertable, and wherein the guide fingers (9, 10) with the guide lugs (11, 12) are also the latching fingers with the latching lugs.

11. The adapter device (1) according to claim 10, characterized in that at least one flat spring (13) each is designed in the first leg (6) and in the second leg (7), with the aid of which the information carrier (2) may be pressed free of play against the latching lugs and the guide lugs (11, 12).

12. The adapter device (1) according to claim 11, characterized in that the flat spring (13) is a curved material web of the first leg (6) and of the second leg (7), respectively.

13. The adapter device (1) according to claim 12, characterized in that the flat spring (13) is situated between the latching fingers and the guide fingers (9, 10).

14. The adapter device (1) according to claim 9, characterized in that at least one flat spring (13) each is designed in the first leg (6) and in the second leg (7), with the aid of which the information carrier (2) may be pressed free of play against the guide lugs (11, 12).

15. The adapter device (1) according to claim 14, characterized in that the flat spring (13) is a curved material web of the first leg (6) and of the second leg (7), respectively.

16. The adapter device (1) according to claim 15, characterized in that the flat spring (13) is situated between the guide fingers (9, 10).

17. The adapter device (1) according to claim 1, characterized in that the second leg (7) includes a stop projection (14) as a stop for the information carrier (2).

18. The adapter device (1) according to claim 1, characterized in that the first leg (6) and/or the second leg (7) includes a spacer projection (15, 16) which, as a positioning aid, serves to position the information carrier (2) in the blockage state essentially parallel to the plane spanned by the first and by the second leg (6, 7).

19. The adapter device (1) according to claim 1, characterized in that the first leg (6) and/or the second leg (7) is flattened on its retaining edge (17, 18) facing away from the joint (8), in order to facilitate the introduction into retaining means (4, 5) of the support rail (3) designed as retaining grooves.

20. The adapter device (1) according to claim 1, characterized in that the joint (8) is a film hinge.

21. A method for fastening an information carrier (2) to a support rail (3) provided with two retaining means (4, 5) using an adapter device (1) according to claim 1, wherein the method comprises the following steps:

pivoting of the first leg (6) relative to the second leg (7) about the joint (8) to thereby obtain a bent adapter device (1), in which the joint (8) is flexed in such a way that the retaining edges (17, 18) of the first leg (6) and of the second leg (7) facing away from the joint (8) occupy a distance from one another, which is smaller than a distance which the two retaining means (4, 5) of the support rail (3) exhibit relative to one another, introducing the bent adapter device (1) into the support rail (3), pivoting the first leg (6) relative to the second leg (7) about the joint (8), to obtain a stretched adapter device (1) in the support rail (3), in which the joint (8) is stretched and an angle of essentially 180° is formed between the first leg (6) and the second leg (7), and connecting the information carrier (2) to both the first connection means (9) of the first leg (6) as well as to the second connection means (10) of the second leg (7) in such a way that the joint (8) of the stretched adapter device (1) is blocked as a result by, and the retaining edges (17, 18) of the first leg (6) and of the second leg (7) are held in a retaining connection with the two retaining means (4, 5) of the support rail (3).

* * * * *